United States Patent [19]

Giovetti

[11] 4,333,658

[45] Jun. 8, 1982

[54] SPORTING IMPLEMENT STRUCTURE, PARTICULARLY FOR SOCCER GAME PRACTICING

[76] Inventor: Giuliano Giovetti, Via Giacomo Boni, 29-Milano, Italy

[21] Appl. No.: 59,939

[22] Filed: Jul. 23, 1979

[30] Foreign Application Priority Data

Jul. 28, 1978 [IT] Italy ..... 22483/78[U]

[51] Int. Cl.[3] ..... A63B 43/02; A63B 69/26

[52] U.S. Cl. ..... 273/411; 273/DIG. 17

[58] Field of Search ..... 273/411, 413, 414, 58 C, 273/DIG. 17, DIG. 19; 46/51

[56] References Cited

U.S. PATENT DOCUMENTS

| | | | |
|---|---|---|---|
| 139,533 | 6/1873 | Batchelder | 46/51 |
| 1,753,310 | 4/1930 | Costello | 273/414 X |
| 3,613,294 | 10/1971 | Graham | 273/DIG. 17 |
| 4,021,035 | 5/1977 | O'Hara | 273/DIG. 19 X |
| 4,071,241 | 1/1978 | Garcia | 273/DIG. 19 X |
| 4,121,822 | 10/1978 | Di Sabatino et al. | 273/DIG. 19 X |

*Primary Examiner*—George J. Marlo

*Attorney, Agent, or Firm*—Guido Modiano; Albert Josif

[57] ABSTRACT

A sporting implement structure particularly for soccer game practicing, comprises a helmet-like element suitable for association with the user's head and having a pair of eyelets located at the user's head sides. To the eyelet pair a pair of strings from the lower free ends whereof a pair of balls are suspended, is connected.

2 Claims, 7 Drawing Figures

SPORTING IMPLEMENT STRUCTURE, PARTICULARLY FOR SOCCER GAME PRACTICING

BACKGROUND OF THE INVENTION

This invention relates to a sporting implement structure, particularly for soccer game practicing.

In prior studies by the same Applicant, there is disclosed a sporting implement for soccer game practicing, which comprises a helmet-like element suitable for association with the user's head and being provided with an eyelet at its front portion, to which eyelet a length of string can be connected, the lower free end whereof is tied to a ball.

That sporting implement did prove extremely useful for its user to learn how to strike the ball correctly and "play" the ball hitting it with various parts of the foot, such as the inside, outside or neck thereof, spinning the ball, shovelling it or touch or stop it, until full control of the ball is achieved.

With the above described sporting implement, the player is enabled, in a way, to train him/herself correctly.

SUMMARY OF THE INVENTION

This invention sets out to provide a sporting implement structure, particularly for soccer game practicing, which affords an improved degree of training possibilities by compelling the user to use continuously and alternately both his/her feet, to achieve perfect synchronization in striking the ball at the right point.

Within that general aim, it is possible to arrange that the user, by striking the ball alternately with its right and left foot while running with outside shovel hits, shortly achieves, additionally to an accurately controlled touch of the ball, perfect synchronization of his steps with ball touching.

It is further possible to arrange that the sporting implement according to this invention has an extremely simplified structure, can be easily manufactured at a high rate, and that furthermore it is highly competitive from a purely economical standpoint.

According to one aspect of the present invention, there is provided a sporting implement structure particularly for soccer game practicing, characterized in that it comprises a helmet-like element suitable for association with the user's head and having a pair of eyelets located at the user's head sides, to said eyelet pair there being connected a pair of strings from the lower free ends whereof a pair of balls are suspended.

BRIEF DESCRIPTION OF THE DRAWINGS

Further features and advantages will become more clearly apparent from the following detailed description of a sporting implement structure particularly for soccer game practicing, illustrated by way of example and not of limitation in the accompanying drawings, where.

DESCRIPTION OF THE PREFERRED EMBODIMENTS

Figure 1:
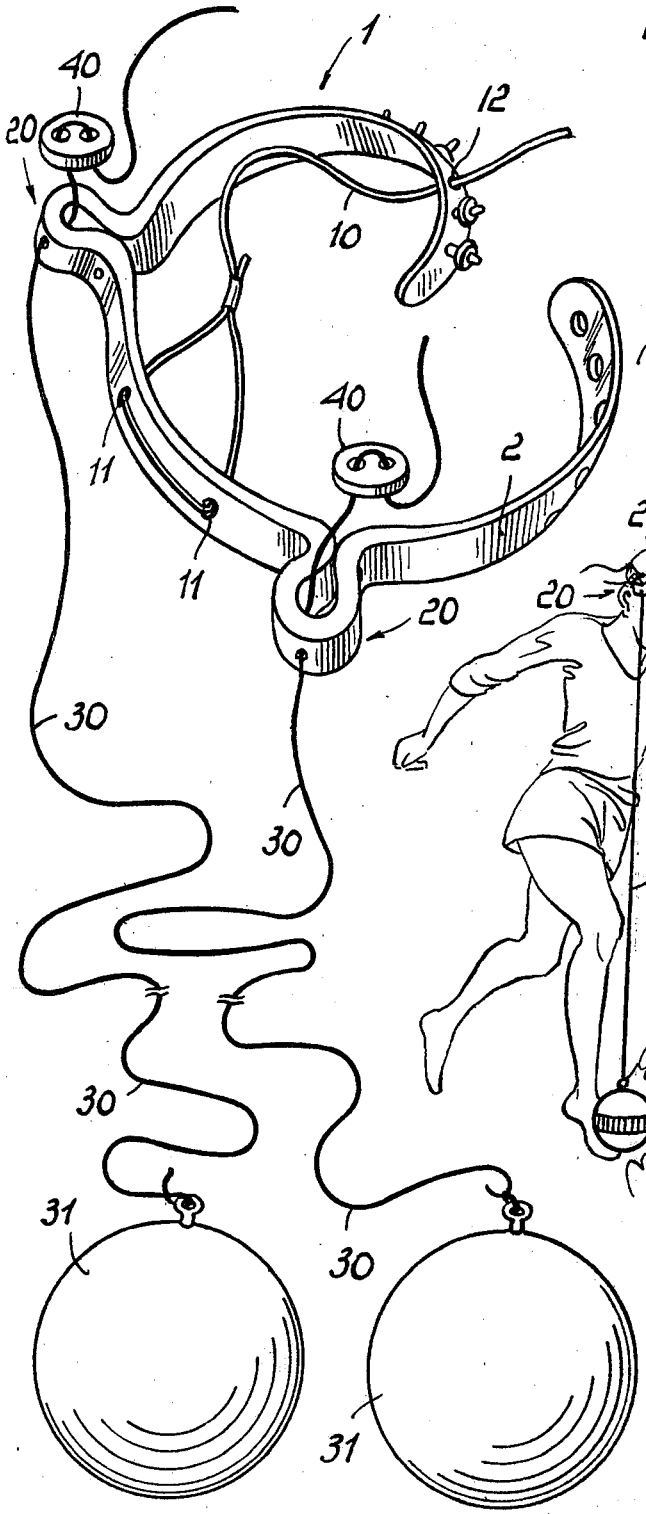
FIG. 1 is a perspective view of this sporting implement structure.

With reference to the drawing figures, the sporting implement structure for soccer game practicing according to this invention, comprises a helmet-like element, generally indicated at 1, which can be associated with the user's head.

The helmet-like element 1 includes an elastic strap 2, which in actual practice will be wrapped around the user's head, and which, if desired, could be formed with a knurled inner surface to further improve its fit around the user's head. Said strap or head band is provided with adjustable release latching means of known type.

Extending across the strap member 2, between the front and the rear side of the helmet-like element 1, there is provided a top supporting member of the helmet-like element 1 comprising a string-like member 10 having a portion intended for insertion through a pair of spaced apart through holes 11 provided in the front portion of the strap 2 and further having a front end connected to a middle portion of the string-like member 10 such as to form in practice, a triangular front arrangement which increases the stability of the helmet-like element 1 when associated with the user's head; the free rear end of the string-like member 10 is passed through a hole 12 provided at one free rear end of the elastic strap 2 which mounts locking means (not shown in detail) for adjusting the length of the string-like member 10 as desired.

Figure 2:
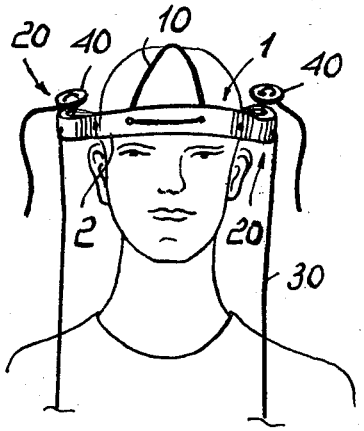
FIG. 2 is a detail view of the helmet-like element as worn by the user.
Figure 6:
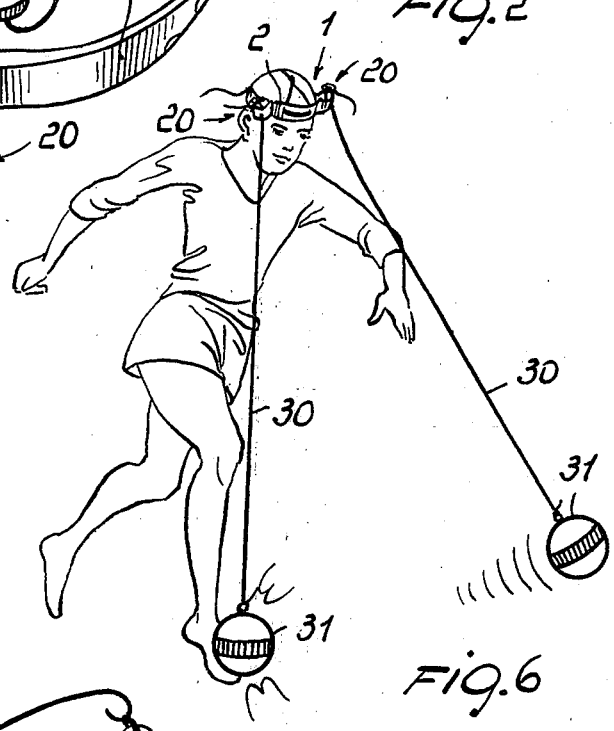
FIGS. 6 and 7 show how the ball is to be struck while running.
Figure 4:
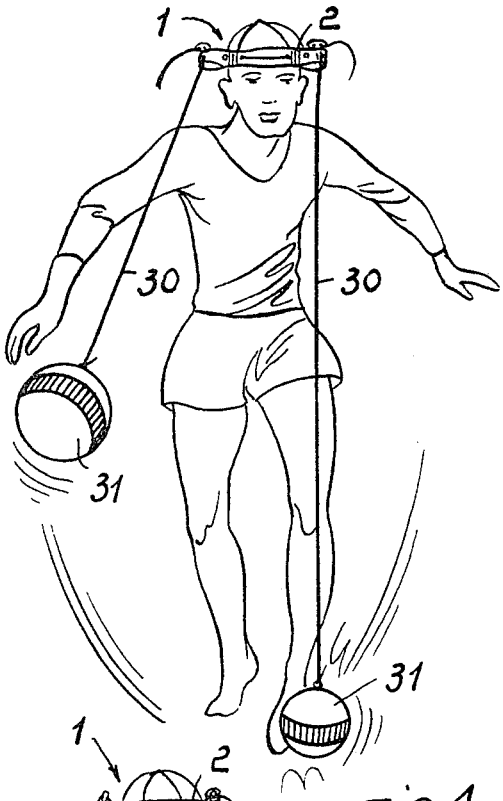
FIGS. 4 and 5 show how the ball is to be struck from a stationary position.
Figure 5:
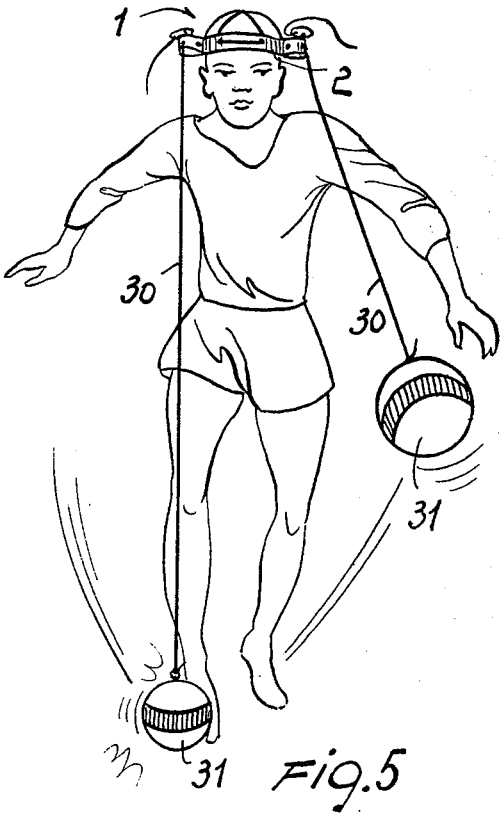
Figure 3:
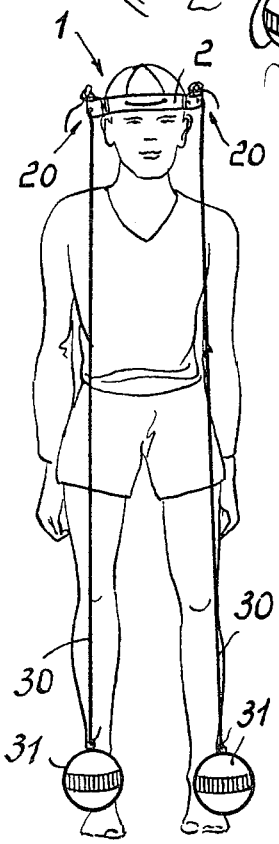
FIG. 3 illustrates the appearance of the sporting implement when worn by its user.
Figure 7:
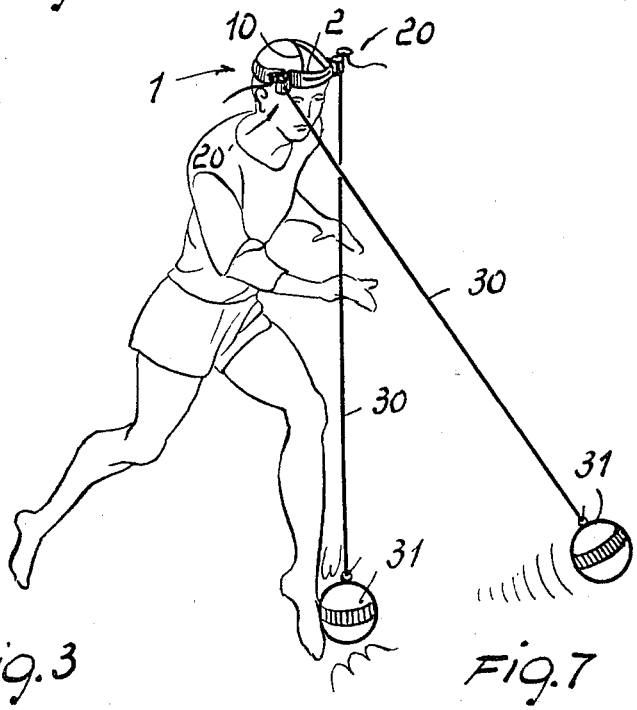

Said elastic strap 2, which in practice makes up the helmet-like element 1, includes a pair of eyelets (or loop formed rings), indicated at 20, which are located, as shown in FIGS. 2 and 3, on either side of the user's head, said eyelets being simply formed by joining together two spaced apart areas of the strap 2.

Advantageously, the elastic strap 2 has, at the eyelets, an increased thickness dimension, thus increasing considerably the stiffness thereof and preventing undesirable excessive downward deflections.

To said pair of eyelets 20, there is connected the top or upper end of a pair of strings 30, to the bottom or lower end whereof a pair of balls 31 are suspended.

At the upper ends of said strings 30, means are provided for adjusting the useful or working length of the strings 30, such means comprising in practice simple locking plates 40, in engagement with the strings 30 and having a size such that they cannot pass through the eyelets 20, thus preventing the strings 30 from disengaging themselves from the eyelets 20. As visible in FIG. 1, the locking plates 40 each have perforation for passing the strings 30 therethrough first from one side of the lock plates and therefrom the other side thereof according to a serpentine arrangement to adjustably lock the strings 30 on the plates 40.

It should be further added that the eyelets 20 are so arranged as to be located substantially at the user's temples, and moreover, to avoid that after a period of use some discomfort may be experienced by the user owing to the eyelets 20 being in constant contact with his temples, soft pads (not shown) may be provided to lie interposed between the eyelets 20 and the user's head, thus preventing the annoyance resulting from the eyelets 20 continuously tapping on the temples.

The device is very simply utilized. After the user has worn the helmet-like element, and has adjusted the length of the strings 30 to suit his/her height, he/she may begin to alternately strike, with the right and left foot, the two balls 31 hanging from the strings 30 until perfect synchronization is achieved in striking the ball.

Moreover, the implement of this invention obliges the user to maintain a perfect balance and correct position of the body, with the right amount of flexing of the leg in contact with the ground.

Furthermore, the user is compelled to alternately strike either balls with either feet, and in order not lose his/her synchronization, to also strike the ball at the correct point with an appropriate force.

An even more beneficial use of this implement is achieved by kicking the balls in running; in fact, by striking the two balls alternately with the right and left foot while running, with an outside shovel (a point of the foot so called for running with the ball), the user learns in a short time how to regulate his/her touch and full synchronization of his/her step with ball touching.

It should be noted that practicing in running is a fairly tiring exercise, thereby, if protracted over long periods of time, the player also stimulates and increases his/her muscle power, reflexes and breathing, to a truly exceptional extent.

It will be apparent from the foregoing that the invention achieves its objects, and in particular, it should be pointed out that the sporting implement described hereinabove can be extremely useful in training soccer players, or any person conversant with ball kicking sports.

In practicing the invention, the materials employed, as well as the dimensions and contingent shapes, can be any ones to suit individual requirements.

I claim:

1. A sporting implement structure particularly for soccer game practicing, comprising:

(a) a helmet-like element for arrangement on the user's head, said helmet-like element comprising an elastic strap for location around the user's head and a top supporting member extending across said elastic strap for location on the top of the user's head;

(b) two eyelets defined by said elastic strap adjacent the user's temples, said eyelets being formed by joining together two spaced apart areas of said elastic strap;

(c) a pair of strings each having one end carrying a ball and another end engaging said elastic strap at a corresponding one of said eyelets;

wherein said top supporting member comprises a string-like member and said elastic strap further comprises two spaced apart through holes in a front portion thereof between said eyelets, said string-like member having a portion inserted through said holes and a front end of said portion re-united to a middle portion of said string-like member to form a substantially triangular arrangement adjacent said front portion of said elastic strap, said string-like member further having a rear end adjustably secured to a rear portion of said elastic strap.

2. A sporting implement structure as claimed in claim 1, further comprising means for adjustably engaging said other end of each of said strings with said elastic strap, said means comprising a locking plate for each of said strings, said locking plates each having perforations for passing a corresponding one of said strings therethrough first from one side of said locking plates and then from another side of said locking plates according to a serpentine arrangement, said locking plates each having a size smaller than said eyelets such as to be retained by said eyelets.

* * * * *